US010233567B2

(12) United States Patent
Owen

(10) Patent No.: US 10,233,567 B2
(45) Date of Patent: Mar. 19, 2019

(54) COTTON GIN FOR PNEUMATIC COTTON HARVESTING MACHINE

(71) Applicant: Thomas Owen, Seven Mile, OH (US)

(72) Inventor: Thomas Owen, Seven Mile, OH (US)

(73) Assignee: Thomas Owen, Seven Mile, OH (US)

( * ) Notice: Subject to any disclaimer, the term of this patent is extended or adjusted under 35 U.S.C. 154(b) by 70 days.

(21) Appl. No.: 15/407,555

(22) Filed: Jan. 17, 2017

(65) Prior Publication Data

US 2017/0204535 A1 Jul. 20, 2017

Related U.S. Application Data

(60) Provisional application No. 62/278,543, filed on Jan. 14, 2016.

(51) Int. Cl.
*D01B 1/08* (2006.01)
*D01G 9/20* (2006.01)

(52) U.S. Cl.
CPC *D01B 1/08* (2013.01); *D01G 9/20* (2013.01)

(58) Field of Classification Search
CPC ... D01B 1/00; D01B 1/02; D01B 1/04; D01B 1/06; D01B 1/08; B02C 13/288; D01H 4/32; D01G 9/00; D01G 9/06; D01G 9/08; D01G 9/12; D01G 9/14; D01G 9/18; D01G 9/20
See application file for complete search history.

(56) References Cited

U.S. PATENT DOCUMENTS 1,031,703 A * 7/1912 Fordyce ..... D01B 1/08 19/55 R
1,280,054 A * 9/1918 Evans ..... A23B 4/052 99/476
1,464,810 A * 8/1923 Evans ..... D01B 1/08 19/57
2,022,564 A * 11/1935 Henry ..... D01B 1/08 19/57
3,162,903 A * 12/1964 Wallace ..... D01B 1/08 19/59
3,266,101 A * 8/1966 Brooks ..... D01B 1/04 19/55 R
3,694,857 A * 10/1972 Nayfa ..... D01B 1/08 19/62 R
4,625,365 A * 12/1986 Nayfa ..... D01B 1/08 19/55 R
6,108,872 A * 8/2000 Nichols ..... D01B 1/08 19/62 A

* cited by examiner

*Primary Examiner* — Ismael Izaguirre
(74) *Attorney, Agent, or Firm* — Berenato & White, LLC

(57) ABSTRACT

A cotton gin for use in a pneumatic cotton harvesting machine. The gin is located in the harvester downstream of the pneumatic picking heads. The gin receives seed bearing cotton balls on a front side of a fiber separation plate. Co-acting and oppositely rotating toothed fiber separation blades protrude through the separation plate and incrementally tear the cotton fiber free from the cotton ball leaving behind the seeds. The separated cotton fiber is, thereafter, drawn from the back or downstream side of the separation plate to a dust collector and then bailed in a dry condition in the harvester in the field. The separated seeds remain in the gin and fall downwardly, via gravity toward and into a seed collecting bin.

4 Claims, 6 Drawing Sheets

COTTON GIN FOR PNEUMATIC COTTON HARVESTING MACHINE

BACKGROUND OF THE INVENTION

1. Field of the Invention

The present inventions relates to agricultural implements for harvesting cotton in general, and more particularly to a cotton gin for associated use in a pneumatic machine for harvesting cotton.

2. Description of the Related Art

Efforts have been made for many years to build cotton harvesting machines which can harvest cotton fiber (cotton balls) from cotton plants as efficiently and cleanly as manual labor but at a higher speed and lower cost. It is known in the prior art to utilize vacuum air suction for harvesting cotton balls. However, the known cotton picking machine using vacuum air suction, are not selective and as such they collect anything from the cotton plants that is sufficiently loose, such as sticks, leaves, dirt particles, etc. As a result, the cotton harvested by the conventional cotton picking machine using vacuum air suction, is dirty (dirt is mixed with the cotton fiber) and of lower quality than cotton picked by hand. The dirt is not removed during the ginning process and the compressed bale is sold to customers in as is condition. Moreover, the conventional cotton picking machines drop approximately 10 to 20% of the cotton fiber to the ground during the picking process.

It is well known in the art that the cotton gin is a machine that quickly and easily separates the cotton fibers from the seeds and thorns. These seeds are either used again to grow more cotton or, if badly damaged, are disposed of. Usually, the cotton gin uses a combination of a wire screen and small wire hooks to pull the cotton through the screen, while brushes continuously remove the loose cotton lint to prevent jams.

In a harvester, the harvested cotton fiber is carried by continuous flows of air through an outlet duct rearwardly to a storage trailer pulled behind the cotton harvesting machine. Preferably, the storage trailer has a movable partition that allows the machine operator to selectively compress the picked cotton to increase storage capacity of the trailer. The trailer is detachable from the cotton harvesting machine. The full trailer is towed to the cotton gin and emptied to continue the picking process.

Therefore, the cotton picking machines are susceptible to improvements that may enhance their performance and cost. With this in mind, a need exists to develop a cotton gin with improved performance, inexpensive, and providing for more cost effective, efficient and low cost maintenance, which is incorporated into a pneumatic cotton picking (harvesting) machine.

BRIEF SUMMARY OF THE INVENTION

According to a first aspect of the invention, there is provided a cotton gin for a pneumatic machine for harvesting cotton. The gin has a first side that accepts harvested cotton balls containing seeds that are taken directly from cotton plants in a dry condition by a pneumatic harvester. The cottons balls come into contact with, and are drawn by gravity and vacuum, towards and onto sets of oppositely rotated fiber removing blades which partially protrude toward through a fiber removal plate. By action of the sharp edged and toothed oppositely rotating blades in combination with the surrounding cotton ball supporting fiber removal plate, cotton fibers are snatched from the cotton balls as the balls are incrementally pulled apart, the seeds are freed from the separated cotton and, ultimately, fall through the gin. The separated cotton seeds remain in the gin and continue to pass via gravity along the first side of the fiber removal plate toward and into a cotton seed bin located beneath the gin.

The separated cotton fibers passing to the second side of the gin are drawn toward a dust remover and bailer located towards the rear side of the harvester. The bailed cotton is dry and seedless and dust free and in condition for market directly from the harvester.

BRIEF DESCRIPTION OF THE SEVERAL VIEWS OF THE DRAWING(S)

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

Figure 3A:
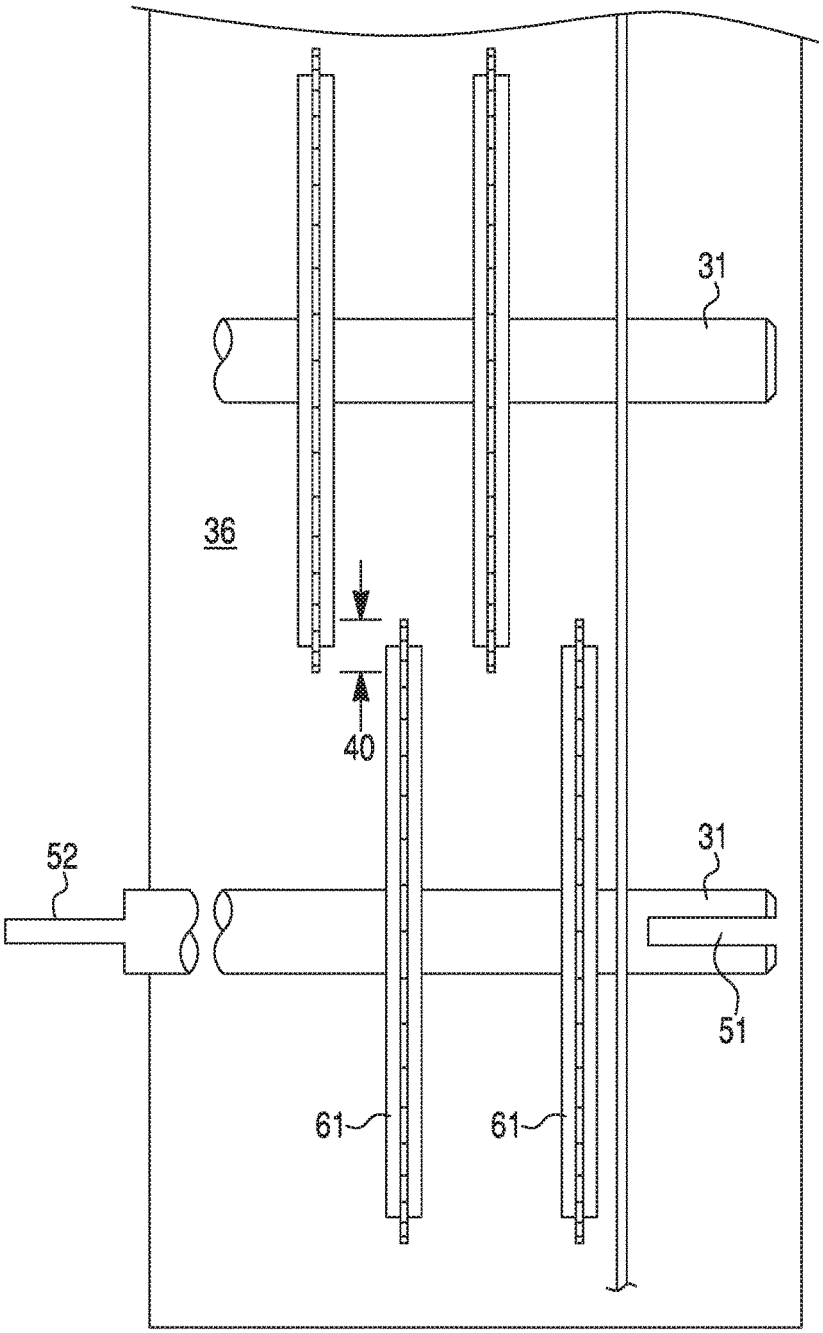

FIG. 3*a* is a plan view of a front side a cotton gin showing the features of the present invention.

Figure 3B:
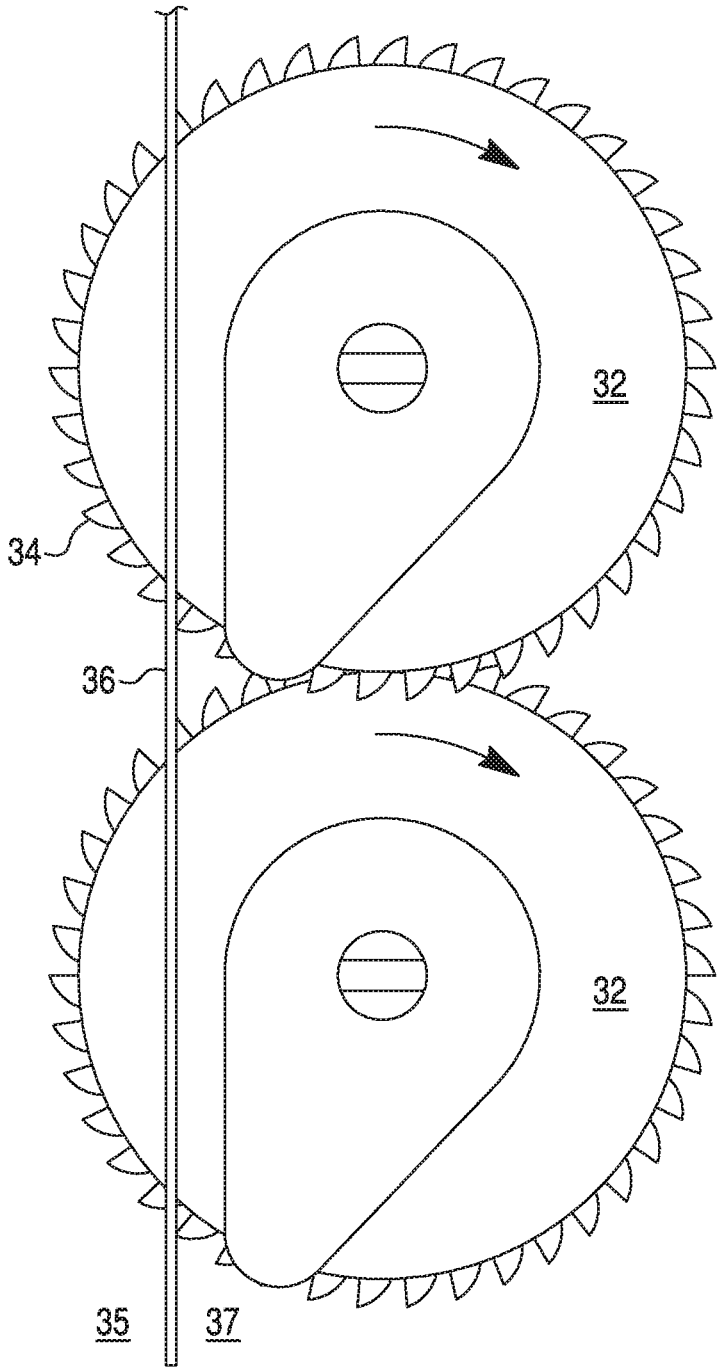

FIG. 3*b* is a partial side view of a cotton gin showing the features of the present invention.

Figure 3C:
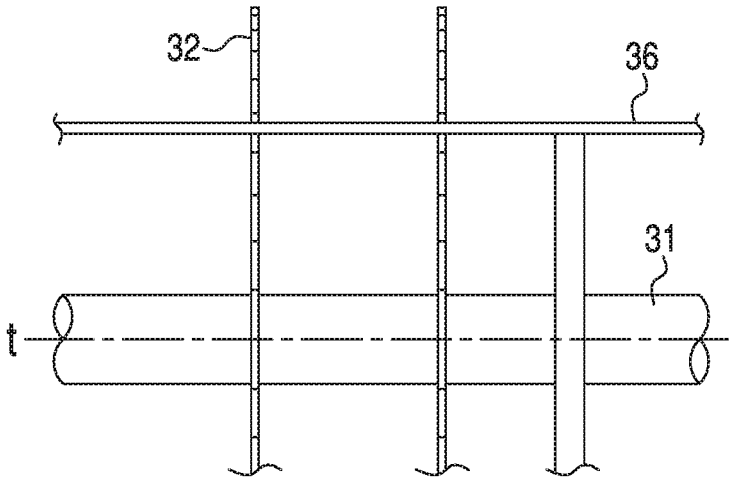

FIG. 3*c* is a partial top view of a cotton gin showing the features of the present invention.

Figure 4:
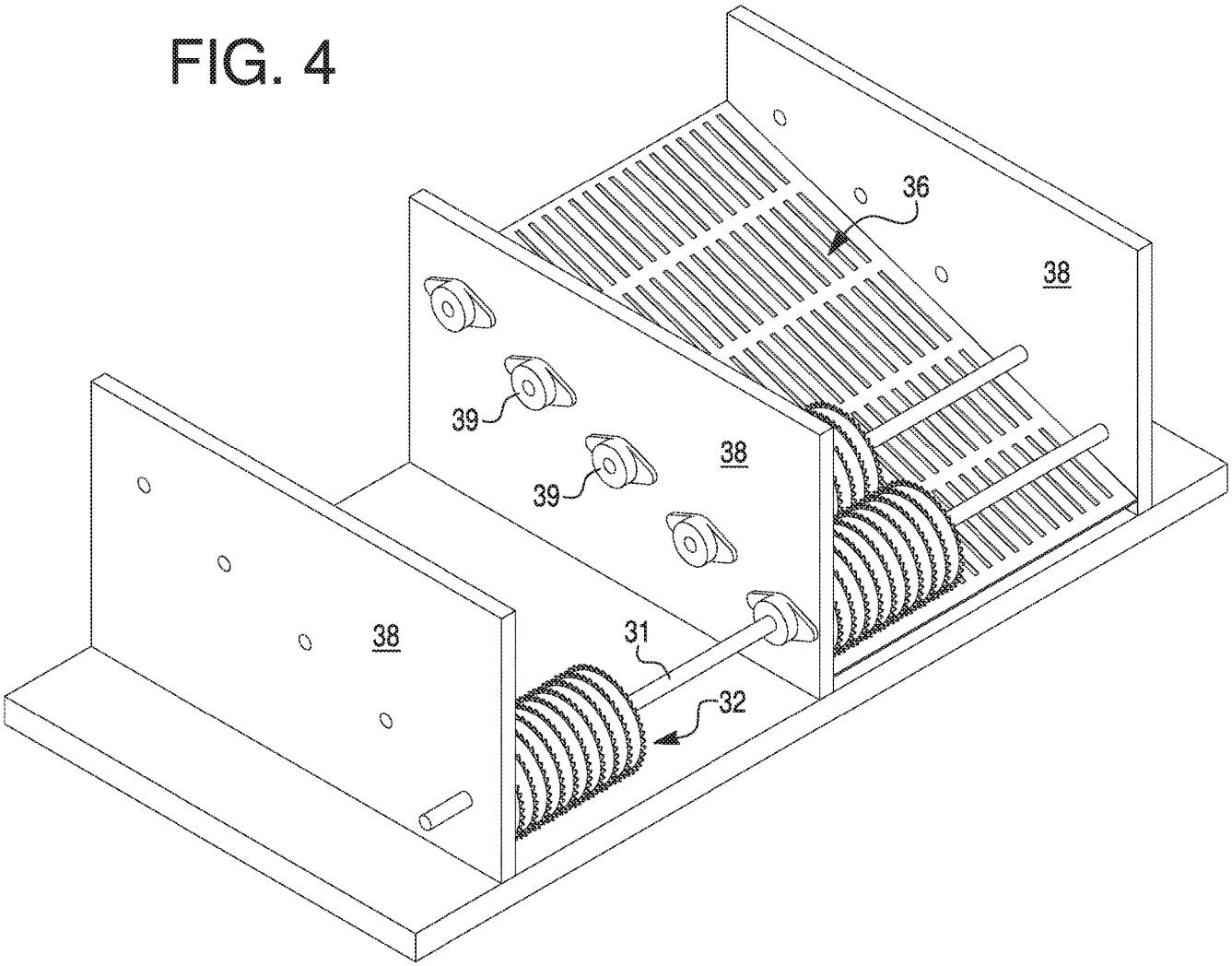

FIG. 4 shows a perspective view of the rear or discharge side of the cotton gin, installed in a frame, in accord with the present invention.

Figure 5:
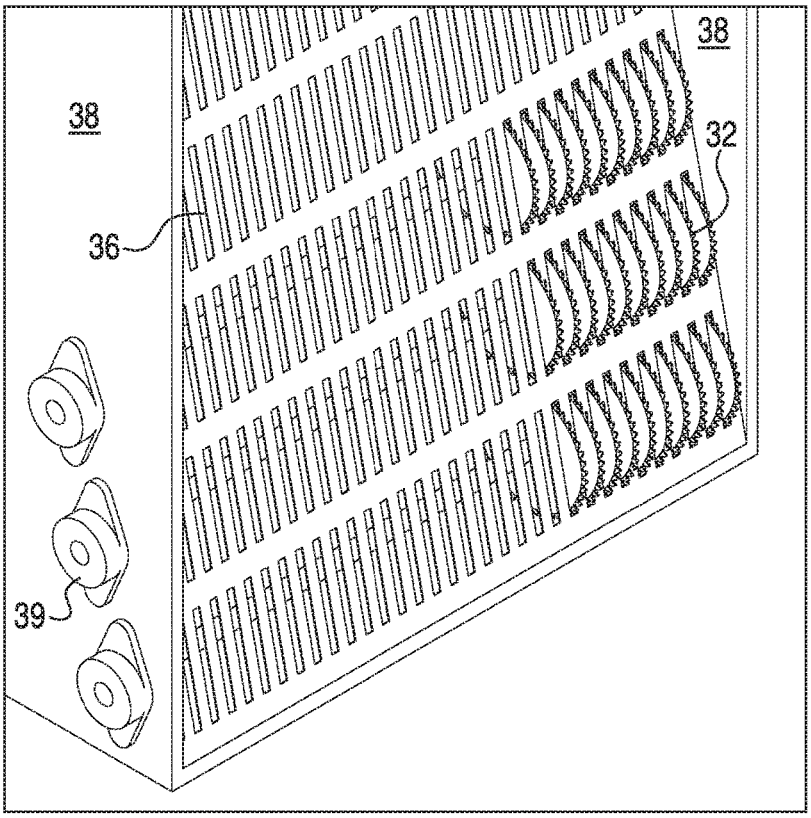

FIG. 5 shows a perspective view of the front or cotton receiving side of the cotton gin, installed in a frame, in accord with the present invention. The end of shaft roller supports are also shown.

DETAILED DESCRIPTION OF EXEMPLARY EMBODIMENT(S) AND EMBODIED METHOD(S) OF THE INVENTION

Reference will now be made in detail to exemplary embodiments and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "up," "down," "upper", "lower", "right", "left", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. Additionally, the word "a" and "an" as used in the claims means "at least one" and the word "two" as used in the claims means "at least two".

Figure 1:
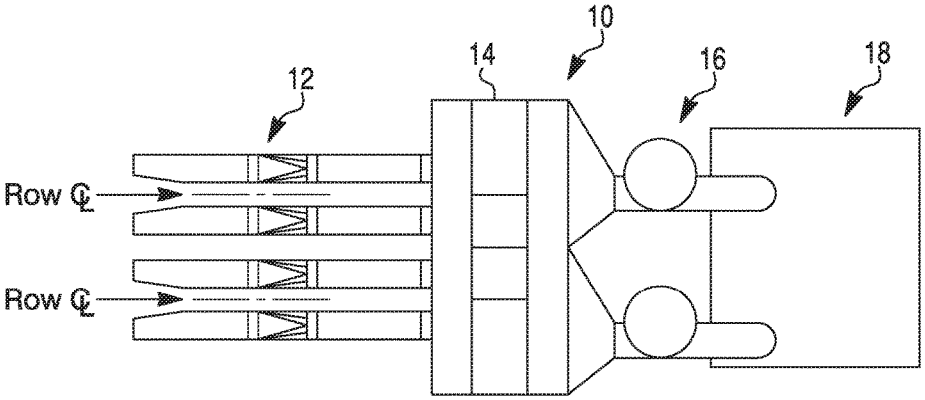
FIG. 1 is a top view of a pneumatic machine for harvesting cotton with a cotton gin in accordance with an exemplary embodiment of the present invention.
Figure 2:
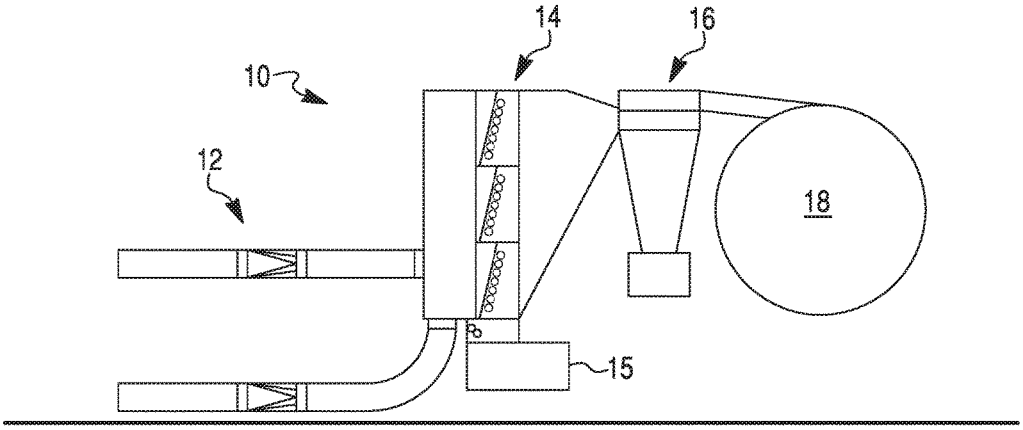
FIG. 2 is a side view of the pneumatic machine for harvesting cotton with the cotton gin in accordance with the exemplary embodiment of the present invention.

An exemplary embodiment of a pneumatic machine for harvesting cotton is generally represented in the accompanying drawings by reference numeral 10, as best shown in the fragmentary sectional views in FIGS. 1 and 2. The details of the pneumatic harvester and its operation are shown in U.S. Pat. No. 7,743,593, and U.S. Pat. No. 8,006,471, the contents of which are incorporated herein by the reference thereto.

The harvester 10, for purposes of the present cotton gin related invention, can be described using the following major components. Towards a forward end of the harvester and aligned along the cotton crop rows are the pneumatic picking heads 12. These heads are connected by tubes that transport the picked and seeded cotton to the gin section 14 of the harvester 10. A seed bin 15 for separated seeds is located beneath the gin, and towards the back of the harvester there is a dust collector 16 and finally a bailer 18. The object is that relatively dust free, dry, seedless cotton is obtained in bale form, ready for sale directly from the harvester in the field; i.e., no conventional, and currently commonplace, soaking, cleaning, or drying steps are necessary.

The details of the gin are shown in FIGS. 3*a*-3*c*. The major elements of the gin unit are the fiber separating plate 36, the oppositely rotating toothed fiber removal blades 32, and the shaft or axle elements 31 rotatably supporting the toothed 34 blades 32 in a specified relationship to the plate 36. As shown in the Figures, the rotating perimeter of the respective blades 32 overlap one to the other rotating edge to rotating edge as shown at 40. This overlap is necessary for the ginning function to proceed as it enables the blades to snatch at the cotton balls and pull the fibers therefrom and separate the seeds. The rotating blades 32, axle shafts 31, and plate 36 are supported by associated from elements (shown in FIGS. 4 and 5).

The incoming cotton falls onto a front side 35 of plate 36 and is snatched, fiber by fiber by teeth 34 through plate 36 via slots 61 to the back side or downstream side 37 of the gin. The separated cotton fiber then travels thru the harvester 10 towards the dust collector and bailer located elsewhere on the harvester. The seeds of the cotton stay on the front side 35 of the cotton removal plate 36 and fall along the plate to the seed bin 15 located beneath stacked or single gin units 14.

Depending on the speed and content rate of the harvested incoming seed bearing cotton balls, the harvester may be equipped with more gin units, connected side to side, using the complementary slots 52 and receiving grooves 51 at the ends of axles 31, and/or be in stacked form where a leading edge of a separation plate of a below positioned unit is positioned rearwardly with respect to the trailing edge of a unit located above. In this way, dislodged seeds and debris can fall along the forwardly oriented surfaces of the respective separation plates. In addition, the gin units can be equipped with variable speed drives to speed or slow the ginning process as necessary to accommodate incoming seed bearing cotton.

FIG. 4 shows the downstream or rearward side 37 of an assembled gin unit. The plate 36 and axle bearings 39 are supported in a frame 38 that holds the respective elements in the specified relationship that enables the cotton and seed separation as shown in FIGS. 3*a*-3*c*.

FIG. 5 shows a forward or front side 35 of the gin unit with blades 32 protruding through the fiber separation plate 36 equipped with slots 61.

The foregoing description of the exemplary embodiment (s) of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as suited to the particular use contemplated, as long as the principles described herein are followed. This application is therefore intended to cover any variations, uses, or adaptations of the invention using its general principles. Further, this application is intended to cover such departures from the present disclosure as come within known or customary practice in the art to which this invention pertains. Thus, changes can be made in the above-described invention without departing from the intent and scope thereof. It is also intended that the scope of the present invention be defined by the claims appended thereto.

What is claimed is:

1. A cotton gin for a pneumatic cotton harvesting machine, comprising:

a frame having two opposed sides;

a fiber separation plate suspended between said opposed sides having an upwardly oriented front side and a downwardly oriented back side and including slots therein, multiple pairs of oppositely rotating toothed blades partially protruding through said slots towards said front side from said back side of said plate, a corresponding set of pairs of shafts respectively supported by said frame and supporting said toothed blades for rotation in a partially overlapping edge to edge relation, wherein, seeded cotton balls come into contact with said front side of said plate and are supported thereby as said oppositely rotating toothed blades snatch and separate cotton fiber from said seeded cottons balls, and pass said cotton fiber to said back side of the fiber separation plate through said slots in said fiber separation plate.

2. A cotton gin as in claim 1, wherein:

said multiple pairs of rotating toothed blades are suspended along, in parallel arrangement, said pairs of shafts co-acting with a single fiber separation plate.

3. A cotton gin as in claim 1, wherein:

multiple pairs of frames supporting multiple pairs of shafts and associated co-acting toothed blades are vertically stacked in the airflow of said pneumatic cotton harvesting machine so as to receive said airflow on respective upwardly oriented front sides of said fiber separations plates.

4. A cotton gin as in claim 3, wherein:

each of said separation plates of said front sides of said fiber separation plates has leading edge and a trailing edge, and in said vertically stacked configuration, a leading edge of a separation plate below another separation plate is in a position rearward of said trailing edge of a trailing edge of a separation plate positioned above.

* * * * *